United States Patent [19]

Robinson et al.

[11] 4,434,196

[45] Feb. 28, 1984

[54] METHOD OF ACCELERATING THE DRYING OF WET HYDROPOHILIC SUBSTRATES

[75] Inventors: Tibor Robinson, Birsfelden; Charles Voegtlin, Arisdorf, both of Switzerland

[73] Assignee: Sandoz Ltd., Basel, Switzerland

[21] Appl. No.: 359,099

[22] Filed: Mar. 17, 1982

[30] Foreign Application Priority Data

Mar. 23, 1981 [DE] Fed. Rep. of Germany ..... 3111392

[51] Int. Cl.[3] ..... B05D 3/02

[52] U.S. Cl. ..... 427/389; 427/389.9; 427/392; 427/393.1

[58] Field of Search ..... 427/389.9, 393.1, 389, 427/392; 8/115.6, 900, 905

[56] References Cited

U.S. PATENT DOCUMENTS

| | | | |
|---|---|---|---|
| 3,382,096 | 5/1968 | Boardman | 427/393.1 X |
| 3,441,435 | 4/1969 | Kirschnek et al. | 427/393.1 X |
| 3,632,559 | 1/1972 | Matter et al. | 525/430 |
| 3,753,931 | 8/1973 | Raspanti | 528/422 |

FOREIGN PATENT DOCUMENTS

| | | |
|---|---|---|
| 49-37760 | 10/1974 | Japan . |
| 602638 | 3/1978 | Sweden . |
| 962421 | 7/1964 | United Kingdom . |
| 1360660 | 7/1974 | United Kingdom . |

*Primary Examiner*—Thurman K. Page

*Attorney, Agent, or Firm*—Gerald D. Sharkin; Richard E. Vila; Thomas C. Doyle

[57] ABSTRACT

A process for accelerating the drying of a wet hydrophilic substrate, e.g. in a washing process, comprising the steps of (i) applying to the wet substrate by an exhaust process 0.05 to 1.0 per kg dry weight of substrate of a mixture comprising a cationic agent having affinity for the fibres and an emulsified polyethylene wax in an aqueous medium, and (ii) subsequently drying the substrate.

27 Claims, No Drawings

METHOD OF ACCELERATING THE DRYING OF WET HYDROPOHILIC SUBSTRATES

This invention relates to a process for accelerating the drying of a wet hydrophilic fibrous substrate, particularly textiles, skins, pelts and leather.

The drying of a wet substrate is an energy- and time-consuming process step. In general, the wet substrate is first submitted to a mechanical treatment, e.g. squeezing, suction or spin drying in a centrifuge, and then heated to remove the residual moisture.

It has now been surprisingly found that the drying of a wet hydrophilic substrate can be substantially accelerated when the substrate is treated before drying with a drying accelerant composition such as disclosed hereafter.

Accordingly, the invention provides a process for accelerating the drying of a wet hydrophilic fibrous substrate, comprising the steps of (i) applying to the wet substrate by an exhaust process 0.05 to 1.0 g per kg dry weight of substrate of a mixture comprising:

(A) a cationic agent having affinity for the fibres, and (B) an emulsified paraffinic wax, in an aqueous medium, and (ii) subsequently drying the substrate.

Suitable cationic agents as component (A) having affinity for the fibres include hydrosoluble compounds whose molecules contain at least one lipophilic aliphatic residue having at least 4 carbon atoms, and at least one cationic nitrogen atom, preferably a quaternary amino group. The aliphatic residue may be in the form of an alkyl, alkenyl or acyl group, and preferably contains from 4 to 22, more preferably 14 to 20, particularly 16 to 18 carbon atoms. Any other alkyl groups in the molecule may contain up to 22 carbon atoms, but are preferably lower alkyl groups containing up to 4 carbon atoms. Example of such cationic agents (A) include more particularly quaternization products of polyamines, e.g. $C_{2-6}$alkylene diamines and poly-$C_{2-4}$alkylene polyamines.

Further cationic agents (A) having affinity for the fibres and which may be used for the process of the invention are for example the protonated or quaternized reaction products of a poly-$C_{2-4}$alkylene polyamine containing at least one secondary amino group with a dicarboxylic acid containing from 4 to 12 carbon atoms or a functional derivative thereof, which reaction products may be further reacted with epichlorhydrin or the reaction product of epichlorhydrin with an aliphatic amine or polyamine, such as disclosed in U.S. Pat. No. 3,632,559; and the reaction products of aliphatic polyamines containing at least one primary or secondary amino group with polyepihalodrins and their salts such as disclosed in U.S. Pat. No. 3,753,931. Such compounds are also hydrosoluble.

Preferred components (A) are the quaternized derivatives of amide-amines of formula I

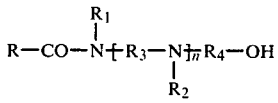

I wherein

R is $C_{4-22}$alkyl or $C_{4-22}$alkenyl $R_1$ and $R_2$ are each independently hydrogen or $C_{1-4}$alkyl;

$R_3$ and $R_4$ are each independently $C_{2-4}$alkylene or $C_{2-4}$alkylene interrupted by —O—, —NH— or —N($C_{1-4}$alkyl)- and n is 0 or an integer from 1 to 10.

R is preferably $C_{14-20}$alkyl or $C_{14-20}$alkenyl, more preferably myristyl, palmityl, stearyl, arachidyl, palmitoleyl, oleyl, linoleyl, alkyl mixture of tallow fatty acid or a mixture of such alkyl or alkenyl groups. Alkyl groups as $R_1$ or $R_2$ are preferably $C_{1-2}$alkyl, more preferably methyl. Alkylene groups as $R_3$ or $R_4$ are preferably $C_{2-3}$alkylene, more preferably ethylene. Preferably the alkylene groups are not interrupted. n is preferably 0 or an integer from 1 to 5, more preferably 0, 1 or 2, most preferably 1.

Suitable quaternization agents for the quaternized components (A), preferably the compounds of formula I, are dimethyl or diethyl sulphate, ethyl bromide, benzyl chloride, epichlorhydrin and the like, preferably dimethylsulphate.

Component (B) is conveniently used as an aqueous emulsion containing a paraffinic wax and an emulsifying agent. The amount of emulsifying agent present in the emulsion may vary from 5 to 25% by weight based on the paraffinic wax, preferably 5 to 10%.

Suitable paraffinic waxes include oxidized waxes consisting of paraffinic hydrocarbons which may contain a relatively high proportion of branched-chain alkanes, e.g. oxidized microcrystalline waxes, or synthetic waxes, preferably oxidized polyethylene waxes. The molecular weight of these waxes may be between 1,000 and 10,000, more preferably between 2,000 and 4,000. Preferred oxidized polyethylene waxes for use in the present invention are those having, independently, an acid number of 5 to 65, preferably 9 to 40, more preferably 10 to 30; an esterification number of 15 to 90, preferably 20 to 80, more preferably 30 to 70; a melting point of at least 60° C., preferably 80° to 105° C., more preferably 90° to 100° C.

The emulsifying agent present in component (B) may be any known agent suitable for emulsifying a paraffinic wax of the type disclosed herein. Preferred emulsifying agents are those having a cationic or nonionic character such as fatty amines, e.g. aliphatic fatty amines in which the fatty group contains from 12 to 22 carbon atoms, e.g. dodecylamine, stearylamine or tallow fatty amine, and their derivatives obtained by condensation with $C_{2-3}$alkylene oxide, preferably 5 to 200 mols ethylene oxide; fatty alcohols, preferably $C_{12-22}$alcohols e.g. lauryl alcohol, oleyl alcohol and their condensation products with $C_{2-3}$alkylene oxide, preferably 5 to 100 mols ethylene oxide; propylene oxide/ethylene oxide block copolymers such as available under the Trade Mark Pluronic; higher $C_{8-24}$alkylphenyl glycol ethers such as isooctylphenol, di-tert.-butylphenol or nonylphenol ethoxylated with 4 to 25 ethyleneoxy units; and fatty acid polyglycol esters such as polyoxyethylene esters of $C_{12-22}$ fatty acid such as oleic, stearic, palmitic or myristic acid. More preferred emulsifying agents are fatty alcohols, their alkylene oxide addition products and the higher $C_{8-24}$alkylphenyl glycolethers.

The weight ratio of component (A) to component (B) based on the active substances (including the emulsifying agent), is preferably from 9:1 to 1:2, more preferably from 6:1 to 1:1 and most preferably from 7:3 to 5:3.

The process of the invention is carried out according to known exhaust methods. The liquor to goods ratio may vary within a wide range, e.g. from 3:1 to 30:1. Components (A) and (B) are added either separately or in the form of a composition to an aqueous bath and the substrate is treated with this bath at a temperature from room temperature to 50° C., so that the mixture of components (A) and (B) are applied onto the substrate by bath exhaustion. Treatment time is conveniently from 1 to 5 minutes, preferably from 90 seconds to 3 minutes. Subsequently, the treated substrate is dried by known methods, e.g. mechanical removal of water at a temperature from room temperature to 80° C. followed by a thermal treatment, conveniently at a temperature from 60° to 130° C., preferably from 80° to 100° C.

Preferably the substrate to be dried is treated with a bath containing the mixture of components (A) and (B) in an amount from 0.1 to 0.5 g, more preferably 0.15 to 0.4 g of active substances (including the emulsifying agent) per kg dry weight of substrate.

The mixture of components (A) and (B) when applied at the indicated amount to a wet hydrophilic substrate, exhibits a good to excellent drying accelerant effect. Not only is the mechanical water removal improved at room temperature or at a higher temperature, e.g. 50° to 80° C., but also the subsequent thermal drying time is significantly reduced, thus enabling substantial time and energy savings. Therefore, the process of the invention may be used in any process which includes the step of drying a wet hydrophilic substrate such as for example dyeing, printing, washing, bleaching and mercerisation of textile substrates, industrial or domestic laundering and tanning and drying of skins, pelts or leather.

According to a preferred embodiment of the invention, the mixture of components (A) and (B) is added to the last bath before the drying step in a washing process, more preferably the laundering of textile goods. The treatment is preferably carried out at a liquor to goods ratio from 3:1 to 10:1, more preferably 3:1 to 7:1, at a temperature from room temperature to 40° C. The treatment bath is conveniently adjusted to an acid pH, preferably from 3 to 6, more preferably from 5 to 6. The treatment with the mixture (A) and (B) may be performed in the usual washing machine or in the last section of a washing tunnel, the bath being agitated or circulating, e.g. according to the counter current principle. The mixture of components (A) and (B) may also be used in the so-called "one-bath method," i.e. it may be added to the last neutralisation or bleaching bath, e.g. hydrogen peroxide or bisulphite bath, before drying.

Components (A) and (B) are preferably added to the treatment bath in form of an aqueous composition. Such a composition may be prepared by mixing component (A) in the presence of water with Component (B). Component (A) is preferably dissolved in water before mixing with the wax emulsion (B). Component (B) is conveniently added in form of an emulsion whose particles have preferably a size below 1μ. Such an emulsion is conveniently prepared by mixing the wax in the melted form with the emulsifying agent in the presence of water. Preferred compositions for the process of the invention are those containing from 15 to 40% by weight, more preferably from 15 to 30% by weight of the mixture (A)+(B) based on the active substances.

In addition to components (A) and (B), the composition may contain further additives such as glycol, particularly a $C_{1-6}$glycol, e.g. ethyleneglycol, butyleneglycol or hexyleneglycol, a perfume, a lustering agent, a hydrophobic agent, etc.

Examples of hydrophilic fibrous substrates which may be treated according to the process of the invention include wool, regenerated or natural cellulose and their blends with synthetic fibres such as polyester, polyamides etc. The textile goods may be in any conventional form, e.g. fabrics, knitted goods, yarns, yarn package, cross-bobbins, roving, cone bobbins, etc.

The following examples in which the temperatures are all in degrees Centigrade illustrate the invention.

EXAMPLE 1

(1a) 70% by weight of N-(hydroxyethylaminoethyl-)oleic acid amide quaternized with dimethylsulphate, and (1b) 30% by weight of a commercially available polyethylene wax dispersion the wax having an average molecular weight of 2,000 an acid number of 24–28, an esterification number of 50–65 and a melting point of 95°–98°, the emulsifying agent being based on a commercially available alkylphenyl polyglycol ether are thoroughly mixed in demineralized water and worked up to a 20% concentrate.

A soiled fabric (100% cotton poplin) with a weight of 108 g/m$^2$ is washed with a commercially available detergent. The above prepared composition is then added to the last rinsing bath in an amount of 0.35 g based on the weight of active substance per kg dry weight of fabric. After spin drying, the fabric is dried at 80°–90°.

The fabric treated according to the invention is dried in a shorter time than untreated goods.

EXAMPLE 2

The procedure of Example 1 is repeated, component (1a) being replaced by the reaction product of 20 mols adipic acid with 21 mols diethylenetriamine further reacted with the reaction product of epichlorhydrin with dimethylamine hydrochloride according to Example 3.1 of U.S. Pat. No. 3,632,559. The drying time in the automatic dryer (80°–90°) is substantially reduced.

EXAMPLE 3

Laundry comprising essentially cotton and staple fibres or blends thereof with polyester or polyamides is washed in a washing machine operating at a rate of 600 kg goods per hour. Each section of the washing machine has a capacity of 35–40 kg goods. The composition of Example 1 is added into the last rinsing section at an amount of 0.31 g based on the weight of active substance per kg dry weight of laundry (pH 5–6 of the bath).

The drying of the washed goods needs about 25% of less energy than in the case of untreated goods. No yellowing of the goods arise during the subsequent ironing in an automatic ironing machine.

EXAMPLE 4

A skin is chrome tanned according to a conventional method. At the end of this operation, the tanned skin is treated in the drum with 0.2 g of the mixture of (1a) and (1b) of Example 1 per kg of dry skin, further drummed for 20 minutes and then horsed up without rinsing.

The water extraction of the treated skin is improved.

EXAMPLE 5

The leather obtained in Example 4 is drummed for 20 minutes after neutralization, retanning, dyeing and fat liquoring, with 0.4 g of the mixture of (1a) and (1b) of Example 1 per kg dry leather and then horsed up. After 1 day piling, the leather is sammed.

The drying of the leather is significantly improved.

What is claimed is:

1. A process for accelerating the drying of a wet hydrophilic fibrous substrate selected from the group consisting of textiles, skins, pelts and leather, which comprises the steps of (i) applying to the wet substrate by an exhaust process 0.05 to 1.0 g. per kg. dry weight of substrate of a mixture comprising (A) a cationic agent having affinity for the fibers, and (B) an emulsified paraffinic wax in an aqueous medium, said component (B) being in the form of an aqueous emulsion containing the paraffinic wax and an emulsifying agent suitable for emulsifying said wax, and, (ii) drying the thus-treated substrate.

2. A process according to claim 1, in which components (A) and (B) are applied in a weight ratio of component (A) to component (B) based on the active substances including the emulsifying agent from 9:1 to 1:2.

3. A process according to claim 1, in which component (A) is a product produced by quaternizing an amide-amine of formula I

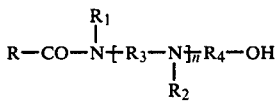

I wherein

R is $C_{4-22}$alkyl or $C_{4-22}$alkenyl $R_1$ and $R_2$ are each independently hydrogen or $C_{1-4}$alkyl $R_3$ and $R_4$ are each independently $C_{2-4}$alkylene or $C_{2-4}$alkylene interrupted by —O—, —NH— or —N($C_{1-4}$alkyl)-, and n is 0 or an integer from 1 to 10.

4. A process according to claim 1, in which the paraffinic wax in component (B) is an oxidized polyethylene wax having a molecular weight from 1,000 to 10,000; an acid number of 5 to 65; an esterification number of 15 to 90; and a melting point of at least 60° C.

5. A process according to claim 1, in which component (B) contains from 5 to 25% by weight of an emulsifying agent based on the paraffinic wax.

6. A process according to claim 1, in which the emulsifying agent in component (B) is selected from aliphatic fatty amines in which the fatty group contains from 12 to 22 carbon atoms, and their derivatives obtained by condensation with $C_{2-3}$alkylene oxide; fatty alcohols and their condensation products with $C_{2-3}$alkylene oxide; propylene oxide/ethylene oxide block copolymers; higher $C_{8-24}$alkylphenyl glycol ethers; and fatty acid polyglycol esters.

7. A process according to claim 1, in which a mixture comprising (A) a product produced by quaternizing an amide-amine of formula I

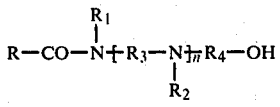

I wherein

R is $C_{4-22}$alkyl or $C_{4-22}$alkenyl $R_1$ and $R_2$ are each independently hydrogen or $C_{1-4}$alkyl $R_3$ and $R_4$ are each independently $C_{2-4}$alkylene or $C_{2-4}$alkylene interrupted by —O—, —NH— or —N($C_{1-4}$alkyl)-, and n is 0 or an integer from 1 to 10, and (B) an emulsified oxidized polyethylene wax having a molecular weight from 1,000 to 10,000, an acid number of 5 to 65, an esterification number of 15 to 90 and a melting point of at least 60° C., is applied.

8. A process according to claim 1, in which the mixture of components (A) and (B) is applied in the last bath before the drying step in a washing process.

9. A process according to claim 1 wherein component (A) is selected from the group consisting of (a) a hydrosoluble compound containing at least one lipophilic aliphatic residue having at least 4 carbon atoms and at least one cationic nitrogen atom, (b) a protonated or quaternized product of reacting a poly-$C_{2-4}$ alkylene polyamine containing at least one secondary amino group with a dicarboxylic acid containing from 4 to 12 carbon atoms or functional derivative thereof, (c) a product of reacting (b) with epichlorohydrin, (d) a product of reacting (b) with the product of reacting epichlorohydrin with an aliphatic amine or polyamine, (e) a product of reacting an aliphatic polyamine containing at least one primary or secondary amino group with a polyepihalohydrin, and (f) a salt of (e).

10. A process according to claim 9 wherein, in the compounds of type (a), the lipophilic aliphatic residue is an alkyl, alkenyl or acyl group containing 4 to 22 carbon atoms.

11. A process according to claim 10 wherein, in the compounds of type (a) the lipophilic aliphatic residue contains 14 to 20 carbon atoms and any other alkyl groups in the molecule contain up to 4 carbon atoms.

12. A process according to claim 3, wherein in formula I

R is $C_{14-20}$alkyl or $C_{14-20}$alkenyl, $R_1$ and $R_2$ are hydrogen or $C_{1-2}$alkyl, $R_3$ and $R_4$ are $C_{2-3}$alkylene, and n is 0 or an integer 1 to 5.

13. A process according to claim 3 wherein, component (A) is the quaternization product of a compound or mixture of compounds of formula I in which R is myristyl, palmityl, stearyl arachidyl, palmitoleyl, oleyl, linoleyl or an alkyl group of a tallow fatty acid, $R_1$ and $R_2$ are hydrogen or methyl, $R_3$ and $R_4$ are ethylene, and, n is 0, 1 or 2.

14. A process according to claim 3 wherein component (A) is a product produced by quaternizing a compound of formula I with dimethyl or diethyl sulphate, ethyl bromide, benzyl chloride or epichlorohydrin.

15. A process according to claim 1 wherein the paraffinic wax is an oxidized wax.

16. A process according to claim 9 wherein the paraffinic wax is an oxidized polyethylene wax.

17. A process according to claim 12 wherein the paraffinic wax in component (B) is an oxidized polyethylene wax having a molecular weight from 1,000 to 10,000; an acid number of 5 to 65; an esterification number of 15 to 90; and a melting point of at least 60° C.

18. A process according to claim 13 wherein the paraffinic wax is oxidized polyethylene having a molecular weight between 2,000 and 4,000, an acid number of 10 to 30, an esterification number of 30 to 70 and a melting point of 90° to 100° C.

19. A process according to claim 16 wherein the weight ratio of component (A) to component (B), based on active substances including emulsifying agent, is from 9:1 to 1:2.

20. A process according to claim 17 wherein the weight ratio of component (A) to component (B), based on active substances including emulsifying agent, is from 6:1 to 1:1.

21. A process for accelerating the drying of a wet hydrophilic fibrous substrate selected from the group consisting of textiles, skins, pelts and leather, which comprises the steps of (i) treating the wet substrate by an exhaust process in the bath containing a mixture of (A) a cationic agent having affinity for the fibers and (B) an emulsified paraffinic wax in an aqueous medium, said component (B) being in the form of an aqueous emulsion containing the paraffinic wax and an emulsifying agent suitable for emulsifying said wax, and said bath containing said mixture in an amount of 0.1 to 0.5 g. of active substance, including the emulsifying agent, per kg. dry weight of substrate, and (ii) drying the thus-treated substrate.

22. A process according to claim 21 wherein component (B) is an oxidized polyethylene wax having a molecular weight from 1,000 to 10,000; an acid number of 5 to 65; an esterification number of 15 to 90; and a melting point of at least 60° C.

23. A process according to claim 22 wherein the weight ratio of component (A) to component (B), based on active substances including emulsifying agent, is from 9:1 to 1:2.

24. A process according to claim 7 wherein step (ii) comprises a thermal treatment at 60° to 130° C.

25. A process according to claim 24 wherein the thermal treatment is effected at 80° to 100° C.

26. A process according to claim 20 wherein step (ii) comprises a thermal treatment at 60° to 130° C.

27. A process according to claim 23 wherein step (ii) comprises a thermal treatment at 60° to 130° C.

* * * * *